US011926945B2

(12) United States Patent
Mifuji

(10) Patent No.: US 11,926,945 B2
(45) Date of Patent: Mar. 12, 2024

(54) UPPER DECORATION MECHANISM AND SEWING MACHINE

(71) Applicant: JANOME Corporation, Hachioji (JP)

(72) Inventor: Tomoro Mifuji, Hachioji (JP)

(73) Assignee: JANOME Corporation, Hachioji (JP)

( * ) Notice: Subject to any disclaimer, the term of this patent is extended or adjusted under 35 U.S.C. 154(b) by 148 days.

(21) Appl. No.: 17/709,416

(22) Filed: Mar. 31, 2022

(65) Prior Publication Data

US 2022/0364288 A1 Nov. 17, 2022

(30) Foreign Application Priority Data

May 13, 2021 (JP) ..... 2021-081878

(51) Int. Cl.
*D05B 61/00* (2006.01)
*D05B 1/10* (2006.01)
*D05C 11/00* (2006.01)

(52) U.S. Cl.
CPC ..... *D05B 61/00* (2013.01); *D05B 1/10* (2013.01); *D05C 11/00* (2013.01)

(58) Field of Classification Search
CPC . D05B 61/00; D05B 1/08; D05B 1/10; D05C 11/00
USPC ..... 112/187
See application file for complete search history.

(56) References Cited

U.S. PATENT DOCUMENTS 5,383,414 A * 1/1995 Winter ..... D05B 61/00 112/162
5,467,725 A * 11/1995 Fujita ..... D05B 61/00 D15/66
5,517,933 A * 5/1996 Karaba, Jr. ..... D05B 53/00 112/475.26
5,901,655 A * 5/1999 Sadasue ..... D05B 53/00 112/165
5,979,346 A * 11/1999 Rodriguez ..... D05B 35/10 112/260
6,318,282 B1 * 11/2001 Tsai ..... D05B 65/00 112/286
6,553,927 B1 * 4/2003 Kawai ..... D05B 61/00 112/220
6,973,887 B2 * 12/2005 Rattay ..... D05B 61/00 112/470.12
7,107,919 B2 * 9/2006 Hasegawa ..... D05B 1/08 112/284
7,806,062 B2 * 10/2010 Klapp ..... D05B 1/06 112/197

(Continued)

FOREIGN PATENT DOCUMENTS

JP H10-137474 A 5/1998
JP 2011-212286 A 10/2011

*Primary Examiner* — Danny Worrell

(74) *Attorney, Agent, or Firm* — Yokoi & Co., U.S.A.; Toshiyuki Yokoi

(57) ABSTRACT

An upper decoration mechanism and a sewing machine without requiring an operation of detaching the upper decoration mechanism from the sewing machine without reducing workability even when performing a double chain stitch not using a decoration thread. The upper decoration mechanism provided on a sewing machine includes an expansion retraction mechanism configured to switch a spreader between an expanded state where the spreader cooperates with needles for performing an upper decoration sewing and a retracted state where the spreader is separated from the needles.

5 Claims, 7 Drawing Sheets

(56) References Cited

U.S. PATENT DOCUMENTS

| | | | | |
|---|---|---|---|---|
| 7,913,634 | B2 * | 3/2011 | Sakano | D05B 61/00 112/275 |
| 7,918,171 | B2 * | 4/2011 | Miyoshi | D05B 87/02 112/225 |
| 2006/0107885 | A1 | 5/2006 | Hasegawa | |
| 2022/0364288 | A1 * | 11/2022 | Mifuji | D05C 11/00 |

* cited by examiner

UPPER DECORATION MECHANISM AND SEWING MACHINE

CROSS-REFERENCES TO RELATED APPLICATIONS

This patent specification is based on Japanese patent application, No. 2021-081878 filed on May 13, 2021 in the Japan Patent Office, the entire contents of which are incorporated by reference herein.

BACKGROUND OF THE INVENTION

1. Field of the Invention

The present invention relates to an upper decoration mechanism provided on a double chain stitch sewing machine and a sewing machine having the upper decoration mechanism.

2. Description of the Related Art

Conventionally, a sewing machine capable of performing a double chain stitch (multi thread chain stitch) defined as 406, 407 and the like in JIS-L0120 is known. In the above described sewing machine, when an upper decoration mechanism is attached, it is possible to perform a double chain stitch with an upper decoration thread (hereafter, referred to as "upper decoration sewing") defined as indication signs 602, 605 (seam of the indication sign 605 is shown in FIG. 7) and the like where the decoration is added to the seam of the indication sign 406 and the like. Note that the thread hatched in FIG. 7 is the decoration thread.

In the sewing machine capable of performing the above described two kinds of double chain stitches, if the upper decoration mechanism is attached when performing the double chain stitch not using the decoration thread, the upper decoration mechanism located near the needles becomes obstructive and workability is reduced. Therefore, the upper decoration mechanism is detached when performing the double chain stitch not using the decoration thread while the upper decoration mechanism is attached when performing the upper decoration sewing. Patent Document 1 proposes that counter-marks are provided on a spreader, which functions as the upper decoration mechanism, and a driving arm of the sewing machine for positioning them with each other when mounting the spreader on the driving arm.

[Patent Document 1] Japanese Unexamined Patent Application Publication No. 2011-212286

BRIEF SUMMARY OF THE INVENTION

Although the operation of positioning the upper decoration mechanism can be simplified in the sewing machine of Patent Document 1, the operator should perform the operation while visually confirming the counter-marks. Thus, the operation itself cannot be omitted. In addition, the upper decoration mechanism detached from the sewing machine may be lost, the upper decoration mechanism may be erroneously broken during the storage and other faults may occur.

The present invention provides an upper decoration mechanism not requiring the operation of removing the upper decoration mechanism from the sewing machine without reducing the workability even when performing the double chain stitch not using the decoration thread and a sewing machine having the upper decoration mechanism.

The present invention relates to an upper decoration mechanism provided on a double chain stitch sewing machine, the upper decoration mechanism including: an expansion retraction mechanism configured to switch a spreader between an expanded state where the spreader cooperates with a needle for performing an upper decoration sewing and a retracted state where the spreader is separated from the needle.

In the above described upper decoration mechanism, it is preferred to further provide a transmission mechanism configured to transmit a force for driving the needle from a main shaft to the spreader in the expanded state while the force is interrupted in the retracted state.

In the above described upper decoration mechanism, it is preferred that the transmission mechanism includes a positioning mechanism configured to adjust operations of the needle and the spreader to a predetermined timing when switching the spreader from the retracted state to the expanded state.

In the above described upper decoration mechanism, it is preferred to further provide a guide mechanism configured to move the spreader in a predetermined path with a predetermined posture when switching the spreader between the expanded state and the retracted state.

In the above described upper decoration mechanism, it is preferred to further provide an upper decoration thread guide configured to switch the spreader between the expanded state for performing the upper decoration sewing by guiding an upper decoration thread to the spreader and the retracted state where the spreader is separated from the needle interlocking with the expansion retraction mechanism.

In addition, the present invention relates to a sewing machine having any one of the upper decoration mechanisms.

By using the upper decoration mechanism of the present invention, the spreader is switched to the expanded state by the above described expansion retraction mechanism to perform the upper decoration sewing without detaching the spreader from the sewing machine. Namely, there is no risk of losing and breaking the spreader, and the workability is improved since the operation of attaching and detaching the spreader is no required. In addition, when the spreader is switched to the retracted state by the expansion retraction mechanism, the spreader can be separated from the needles. Thus, the double chain stitch not using the decoration thread can be performed with high workability.

DETAILED DESCRIPTION OF THE INVENTION

Hereafter, an embodiment of an upper decoration mechanism of the present invention and an embodiment of a sewing machine having the upper decoration mechanism will be explained with reference to the drawings. In the following explanation, the explanation will be made using the directions of right, left, front, rear, up, down, X, Y and Z for convenience.

Figure 1:
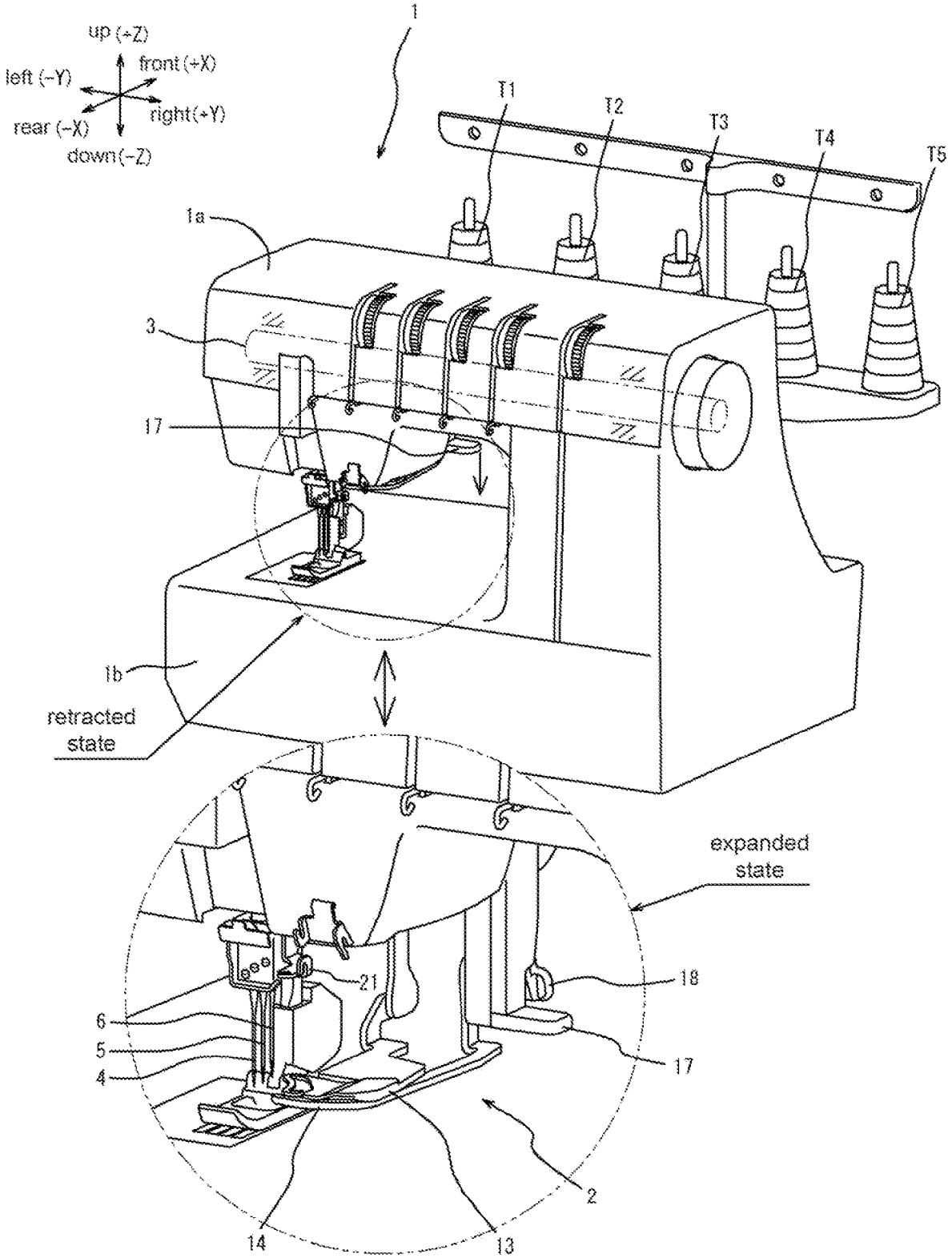
FIG. 1 is a perspective view showing an embodiment of a sewing machine having an upper decoration mechanism of the present invention.

FIG. 1 shows a sewing machine 1 realizing a sewing machine of the present invention.

An upper decoration mechanism 2 realizing an upper decoration mechanism of the present invention is mounted on the sewing machine 1. A main shaft 3 rotated by a not-illustrated sewing machine motor is provided on an arm portion 1*a* of the sewing machine 1. A not-illustrated lower shaft rotated by the sewing machine motor is provided on a bed portion 1*b* of the sewing machine 1. The upper decoration mechanism 2 (including a later-described spreader 14) and needles (comprised of three needles: a first needle 4; a second needle 5; and a third needle 6 in the present embodiment) are connected to the main shaft 3. A looper mechanism (not-illustrated) and a feed mechanism (not-illustrated) provided on the bed portion 1*b* are connected to the lower shaft. In addition, a first needle thread T1, a second needle thread T2, a third needle thread T3, a decoration thread T4 and a looper thread T5 wound around thread reels are attached to the sewing machine 1. The sewing machine motor is rotated and the elements connected to the upper shaft 3 and the lower shaft are cooperated with each other. Thus, the seams are formed by the first needle thread T1 and the like so that the cloth is sewn. By using the sewing machine 1 of the present embodiment, an upper decoration sewing shown in FIG. 7 can be performed and the double chain stitch not using the decoration thread T4 can be also performed. Note that a needle thread guide 21 and other members are attached to the sewing machine 1 around the third needle 6 and the like.

A partially enlarged view of FIG. 1 shows an expanded state where the spreader 14 is moved near to the third needle 6 and the like. When the sewing machine motor is rotated in this state, the upper decoration sewing can be performed. An entire perspective view of FIG. 1 shows a retracted state where the spreader 14 is moved upward and separated from the third needle 6 and the like. When the sewing machine motor is rotated in this state, the double chain stitch not using the decoration thread T4 can be performed. In the upper decoration mechanism 2 of the present embodiment, when a later described expansion lever 17 is pressed downward in the retracted state, the spreader 14 can be switched to the expanded state. When a retraction lever 18 is pressed from front to rear in the expanded state, the spreader 14 can be switched to the retracted state.

Figure 2:
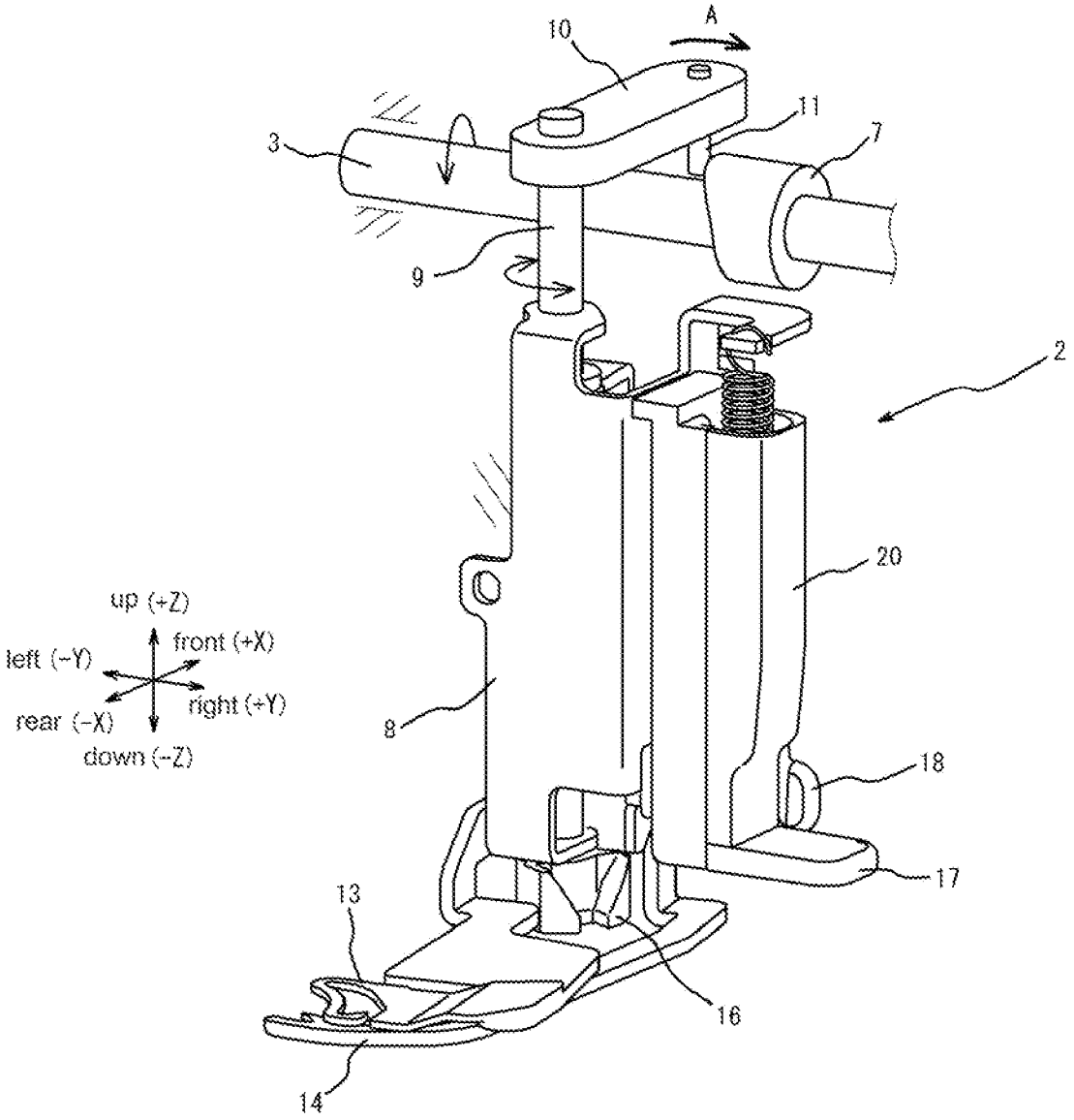
FIG. 2 is a perspective view of the upper decoration mechanism shown in FIG. 1.

FIG. 2 shows the upper decoration mechanism 2 and the main shaft 3 in the retracted state. An upper decoration cam 7 is attached to the main shaft 3 so that the upper decoration cam 7 is rotated together with the main shaft 3. In addition, the upper decoration mechanism 2 includes a base plate 8. The base plate 8 is fixed to a not-illustrated sewing machine frame. Furthermore, the upper decoration mechanism 2 includes an upper decoration shaft 9 having a long columnar (cylindrical) shape, a connection plate 10 having a plate shape, and a follower pin 11 having a short columnar (cylindrical) shape. Here, the base plate 8 supports the upper decoration shaft 9 so that the upper decoration shaft 9 is rotatable. As shown in the drawing, one end of the connection plate 10 is connected to the upper decoration shaft 9 while the other end of the connection plate 10 is connected to the follower pin 11. Note that the upper decoration shaft 9 is energized by a not-illustrated spring in the direction of an arrow A (clockwise in the view from up to down) and the follower pin 11 is always in contact with the upper decoration cam 7. Therefore, the main shaft 3 is rotated in accordance with the upper decoration cam 7, and the upper decoration shaft 9 is rocked in accordance with the rotation of the main shaft 3.

Figure 3:
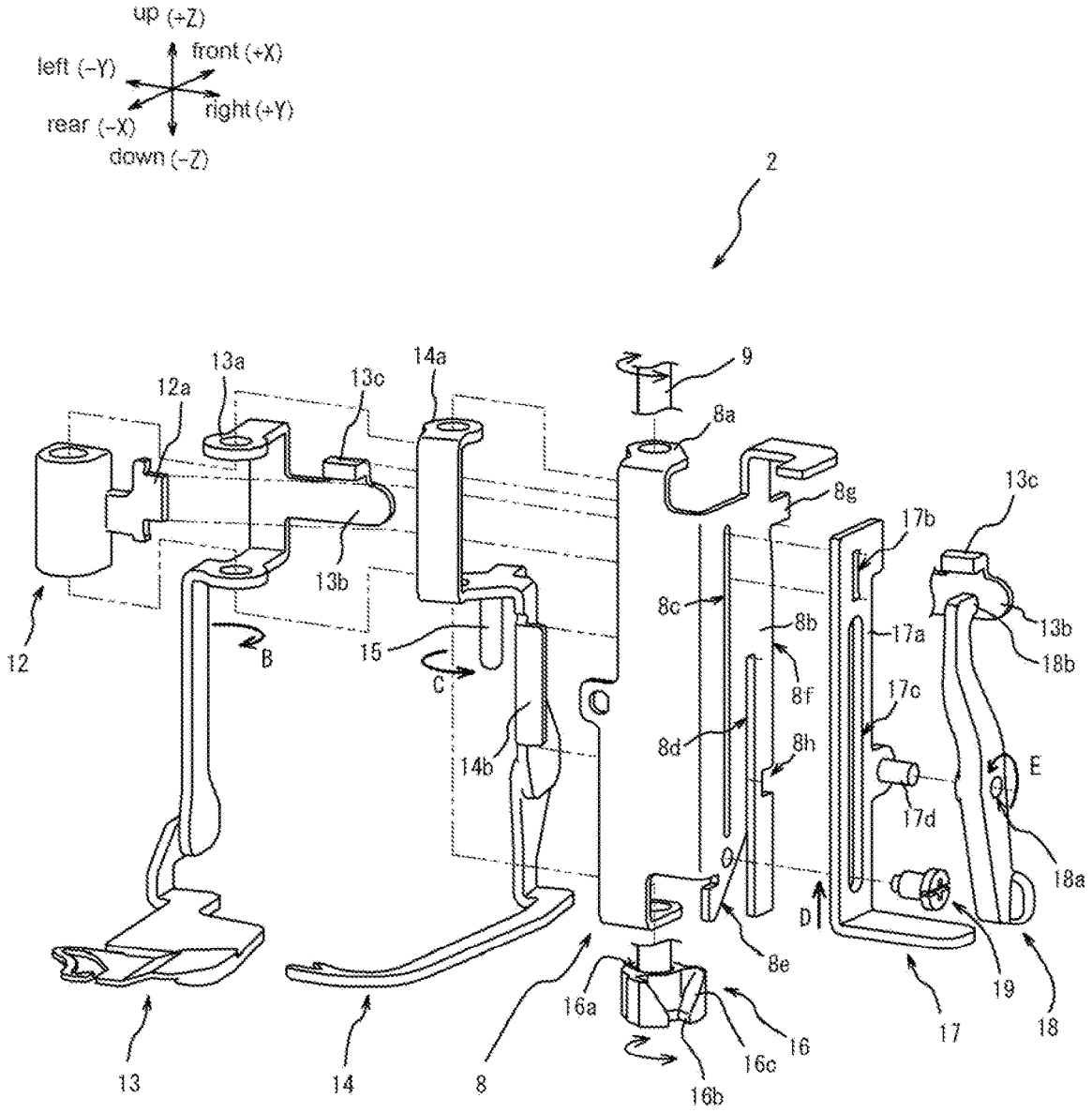
FIG. 3 is an exploded view of the upper decoration mechanism shown in FIG. 1.

FIG. 3 is an exploded view of the upper decoration mechanism 2. The upper decoration mechanism 2 of the present embodiment further includes a mechanism core 12, an upper decoration thread guide 13, a spreader 14, an upper coupler 15, a lower coupler 16, an expansion lever 17, a retraction lever 18 and a stepped screw 19. In FIGS. 3, 4A, 4B, 5A and 5B, a cover 20 and some other components are omitted for the convenience of the illustration.

The mechanism core 12 is formed in a substantially hollow shape. The mechanism core 12 is inserted around the upper decoration shaft 9 and supported by the upper decoration shaft 9 so as to be rotatable and slidable in the axial direction with respect to the upper decoration shaft 9. In addition, the mechanism core 12 includes a slide portion 12*a* protruded from an outer peripheral surface of the mechanism core 12.

The upper decoration thread guide 13 includes a pair of support portions 13*a* provided at an interval in the vertical direction. Each of the pair of support portions 13*a* has a hole into which the upper decoration shaft 9 can be inserted. The interval between the support portions 13*a* is substantially identical to a whole length of the mechanism core 12. In addition, the upper decoration thread guide 13 includes a release portion receiver 13*b* having a plate shape extended from left to right and a positioning portion 13*c* provided on an upper end of the release portion receiver 13*b* so as to be protruded from front to rear.

The spreader 14 includes a hole capable of being inserted around the upper decoration shaft 9 and a pair of support portions 14*a* provided at an interval in the vertical direction. The interval between the support portions 14*a* is substantially identical to the length from an upper surface of one of the support portions 13*a* located on the upper side to a lower surface of the other of the support portions 13*a* located on the lower side. In addition, the spreader 14 includes a spreader retreat cam follower 14*b* protruded from left to right.

The upper coupler 15 has a short columnar shape. An upper end of the upper coupler 15 is connected to the spreader 14 in a state that the upper coupler 15 is directed in the vertical direction. Namely, the upper coupler 15 is integrally operated with the spreader 14. Note that a lower end of the upper coupler 15 is formed in a semispherical shape.

The lower coupler 16 includes a connection hole 16*a* connected to the lower end of the upper decoration shaft 9. Since the lower coupler 16 and the upper decoration shaft 9 are attached with a predetermined angle relation, the rocking angle of the lower coupler 16 is uniquely determined by the rotation angle of the upper decoration cam 7. In addition, the lower coupler 16 includes a spreader angle determining cam portion 16*b* having a groove shape extended in the vertical direction at an outside of the connection hole 16*a* in the radial direction. Note that the width of the groove of the spreader angle determining cam portion 16*b* is substantially identical to the outer diameter of the upper coupler 15. A pair of inclined portions 16*c* is provided on the upper part of the spreader angle determining cam portion 16*b* so that the interval is gradually increased from the lower part to the upper part.

The expansion lever 17 is formed in an approximately L shape. A slide portion fixing hole 17*b* and a stepped screw slide portion 17*c* located at the lower part of the slide portion fixing hole 17*b* are provided on a plate-shaped portion 17*a* which is vertically extended. In addition, a rotary pin 17*d* having a columnar shape extended to the right side is provided on the plate-shaped portion 17*a*.

The retraction lever 18 is located at a center part in the longitudinal direction. The retraction lever 18 includes a pin hole 18*a* into which the rotary pin 17*d* can be inserted. A positioning release portion 18*b* protruded from rear to front is provided on the upper end portion of the retraction lever 18.

Note that the upper decoration mechanism 2 includes not-illustrated springs for energizing the upper decoration thread guide 13, the spreader 14, the expansion lever 17 and the retraction lever 18 respectively. The upper decoration thread guide 13 is energized in the direction of an arrow B (clockwise in the view from up to down), the spreader 14 is energized in the direction of an arrow C (counterclockwise in the view from up to down), the expansion lever 17 is energized in the direction of an arrow D (direction from down to up), and the retraction lever 18 is energized in the direction of an arrow E (counterclockwise in the view from right to left).

Here, the above described base plate 8 will be explained. The base plate 8 of the present embodiment includes a hole into which the upper decoration shaft 9 can be inserted and a pair of support portions 8*a* provided at an interval in the vertical direction. In addition, a slide groove 8*c* is provided on a plate-shaped portion 8*b* located at the right side of the base plate 8 so that the slide groove 8*c* penetrates through the base plate 8 and extends in the vertical direction. In addition, a spreader slide groove 8*d* is provided on the plate-shaped portion 8*b* so that spreader slide groove 8*d* extends in the vertical direction at the front side of the slide groove 8*c*. A spreader retreat cam portion 8*e* gradually increased from the upper part to the lower part in the front-rear direction is provided on the lower part of the spreader slide groove 8*d*. In addition, an upper decoration thread slide cam portion 8*f* extending in the vertical direction is provided on the front end portion of the plate-shaped portion 8*b*. A stopper 8*g* protruded from rear to front is provided on the upper part of the upper decoration thread slide cam portion 8*f*. A positioning groove 8*h* is provided on the lower part of the upper decoration thread slide cam portion 8*f* so that the positioning groove 8*h* cuts the plate-shaped portion 8*b* from front to rear.

The above described components forming the upper decoration mechanism 2 can be assembled by the following procedures, for example. First, the pin hole 18*a* is inserted around the rotary pin 17*d* so that the retraction lever 18 is rotatably supported on the expansion lever 17. Note that the retraction lever 18 is held on the expansion lever 17 while preventing retraction lever 18 from slipping off by a not-illustrated slip-off preventing mechanism (e.g., narrow groove is formed on a tip end portion of the rotary pin 17*d* and an E-ring is fitted into the narrow groove after the pin hole 18*a* is inserted). Then, the stepped screw 19 inserted into the stepped screw slide portion 17*c* is screwed and fixed to the base plate 8. Consequently, the expansion lever 17 is supported on the base plate 8 so as to be movable in the vertical direction.

For attaching the mechanism core 12, the upper decoration thread guide 13 and the spreader 14 to the base plate 8, after the mechanism core 12 is sandwiched by the pair of support portions 13*a* and the pair of support portions 13*a* is sandwiched by the pair of support portions 14*a*, the upper decoration shaft 9 inserted into one of the support portions 8*a* of the base plate 8 is inserted into the support portions 14*a* and other portions. When the mechanism core 12 and other members are assembled with the base plate 8, the slide portion 12*a* is inserted through the slide groove 8*c* and inserted into the slide portion fixing hole 17*b*. Then, the lower end portion of the upper decoration shaft 9 is inserted into the connection hole 16*a* of the lower coupler 16. Thus, the lower coupler 16 is attached to the upper decoration shaft 9.

In the above described assembled state, the mechanism core 12, the upper decoration thread guide 13, the spreader 14, the expansion lever 17 and the retraction lever 18 are supported so as to integrally move in the vertical direction with respect to the base plate 8 and the upper decoration shaft 9. In addition, since the expansion lever 17 is energized in the direction of the arrow D, the mechanism core 12, the upper decoration thread guide 13, the spreader 14, the expansion lever 17 and the retraction lever 18 are positioned in the vertical direction when the positioning portion 13*c* abuts on the lower end portion of the stopper 8*g*. In addition, since the decoration thread guide 13 is energized in the direction of the arrow B, the positioning portion 13*c* is positioned in the circumferential direction when the positioning portion 13*c* abuts on the upper decoration thread slide cam portion 8*f*. Furthermore, since the spreader 14 is energized in the direction of the arrow C, the spreader retreat cam follower 14*b* is positioned in the circumferential direction in a state that the spreader retreat cam follower 14*b* is inserted into the spreader slide groove 8*d*. Here, although the retraction lever 18 is energized in the direction of the arrow E, the retraction lever 18 is covered with the cover 20 shown in FIG. 2. Thus, the retraction lever 18 is not rotated excessively in the direction of the arrow E even when it is energized. Although the upper coupler 15 is a portion to be inserted into the spreader angle determining cam portion 16*b* of the lower coupler 16 as described later, the upper coupler 15 is located above the lower coupler 16 in a state that the positioning portion 13*c* abuts on the lower end part of the stopper 8*g*.

Figure 4A:
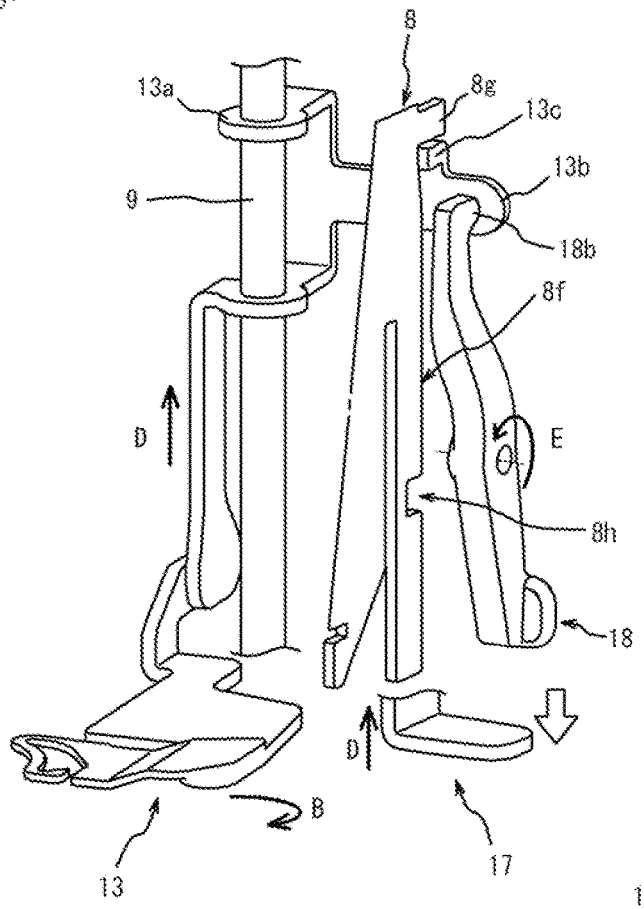
FIG. 4A and FIG. 4B are explanatory drawings related to an expanded state and a retracted state of an upper decoration guide of the upper decoration mechanism shown in FIG. 1.
Figure 4B:
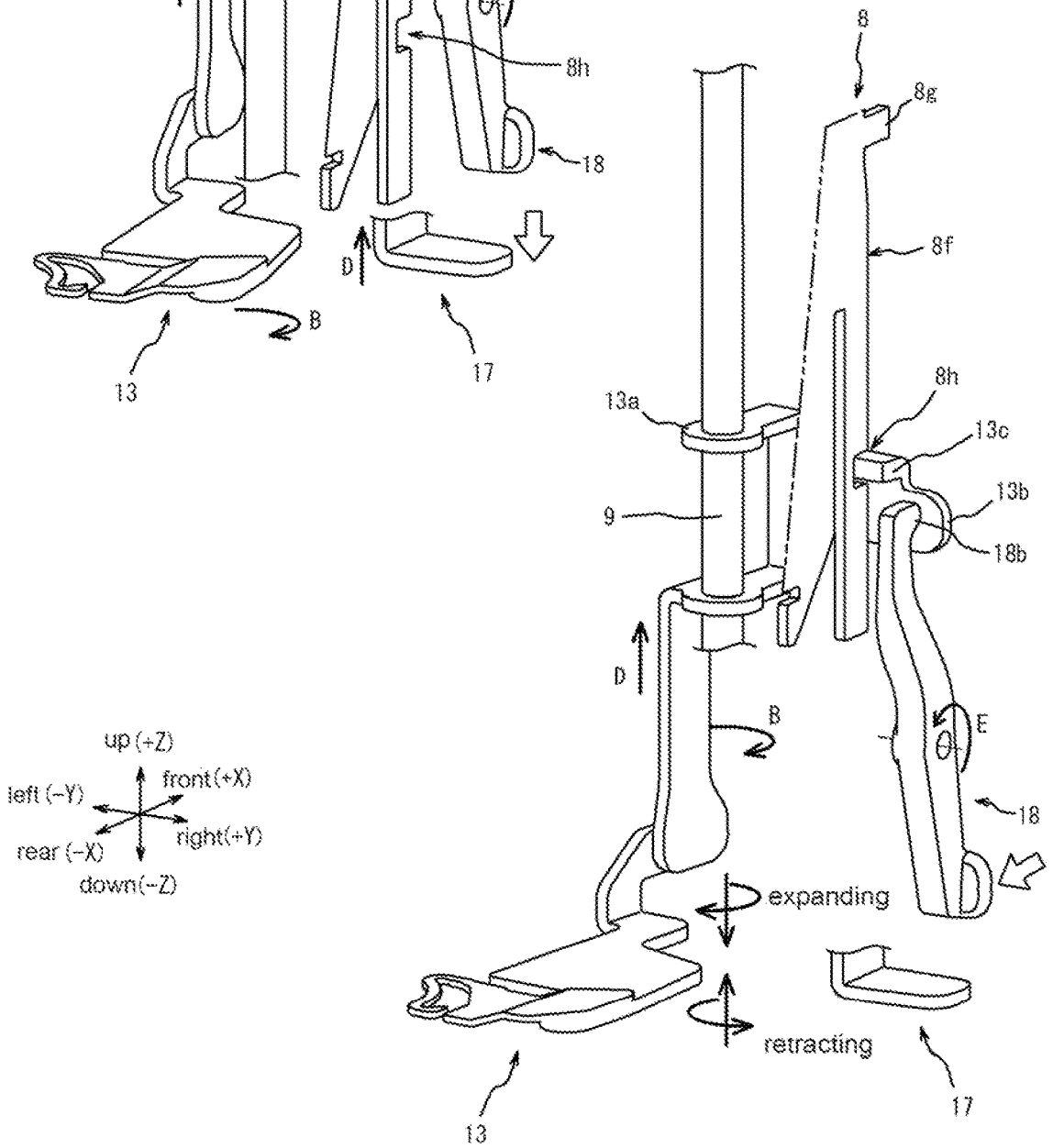

Next, the retracted state and the expanded state of the upper decoration mechanism 2 of the present embodiment will be explained. The retracted state and the expanded state of the upper decoration thread guide 13 will be explained with reference to FIGS. 4A and 4B. In FIGS. 4A and 4B, the base plate 8 and the expansion lever 17 are partly shown. In addition, FIG. 4A is a drawing showing the retracted state while FIG. 4B is the drawing showing the expanded state.

As shown in FIG. 4A, the expansion lever 17 is energized in the direction of the arrow D in the retracted state. Therefore, the upper decoration thread guide 13 which integrally moves in the vertical direction with the expansion lever 17 is also energized in the direction of the arrow D. Accordingly, the positioning portion 13*c* abuts on the lower end portion of the stopper 8*g* and the upper decoration thread guide 13 is not moved in the vertical direction. In addition, since the upper decoration thread guide 13 is energized in the direction of the arrow B, the positioning portion 13*c* abuts on the upper decoration thread slide cam portion 8*f*.

When the expansion lever 17 is pressed downward, the upper decoration thread guide 13 which integrally moves in the vertical direction with the expansion lever 17 is moved downward in a state that the positioning portion 13*c* abuts on the upper decoration thread slide cam portion 8*f*. When the positioning portion 13*c* comes to the positioning groove 8*h*, the positioning portion 13*c* is fitted to the positioning groove 8*h* by the energizing force in the direction of the arrow B. Namely, since the upper decoration thread guide 13 is positioned in the vertical direction by the positioning portion 13*c* and the positioning groove 8*h*, the upper decoration thread guide 13 and the expansion lever 17 are kept in the state of being moved below (the expanded state) even if the user releases the expansion lever 17.

As described above, when the upper decoration thread guide 13 is switched from the retracted state to the expanded state by pressing down the expansion lever 17, the upper decoration thread guide 13 is lowered while keeping the angle around the upper decoration shaft 9 and rotated in the direction of the arrow B when the positioning portion 13*c* is fitted to the positioning groove 8*h*. Namely, the upper decoration thread guide 13 is located near the third needle 6 and the like in the expanded state as shown in partially enlarged view of FIG. 1. However, when switching from the retracted state to the expanded state, the upper decoration thread guide 13 is lowered while keeping the angle rotated in the direction of separating from the third needle 6 and the like. Thus, the upper decoration thread guide 13 can be prevented from colliding with the third needle 6 and the like and the needle thread guide 21 and the like provided on the periphery of the third needle 6.

On the other hand, when switching from the expanded state to the retracted state, as shown in FIG. 4B, the lower end portion of the retraction lever 18 is pressed from front to rear.

By the above described operation, the retraction lever 18 is rotated in the reverse direction of the arrow E. Thus, the positioning release portion 18*b* abuts on the release portion receiver 13*b* of the upper decoration thread guide 13. Consequently, since the upper decoration thread guide 13 is rotated in the reverse direction of the arrow B, the engagement between the positioning portion 13*c* and the positioning groove 8*h* is released. After that, the upper decoration thread guide 13 is moved upward while the positioning portion 13*c* abuts on the upper decoration thread slide cam portion 8*f* by the energizing force in the direction of the arrow B and the energizing force in the direction of the arrow D. Then, the upper decoration thread guide 13 is stopped at the position where the positioning portion 13*c* abuts on the lower end portion of the stopper 8*g*.

As described above, when switching from the expanded state to the retracted state, the upper decoration thread guide 13 is raised after rotated in the reverse direction of the arrow B. Namely, as shown in partially enlarged view of FIG. 1, the upper decoration thread guide 13 located near the third needle 6 and the like in the expanded state is separated from the third needle 6 and the like and then raised while keeping the angle. Thus, the upper decoration thread guide 13 can be prevented from colliding with the third needle 6 and the like and the needle thread guide 21 and the like provided on the periphery of the third needle 6.

Figure 5A:
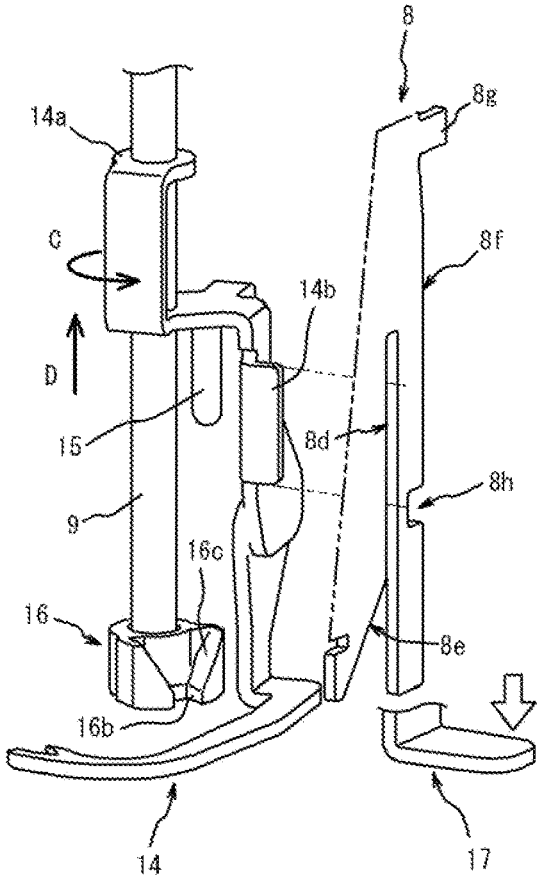
FIG. 5A and FIG. 5B are explanatory drawings related to an expanded state and a retracted state of a spreader of the upper decoration mechanism shown in FIG. 1.
Figure 5B:
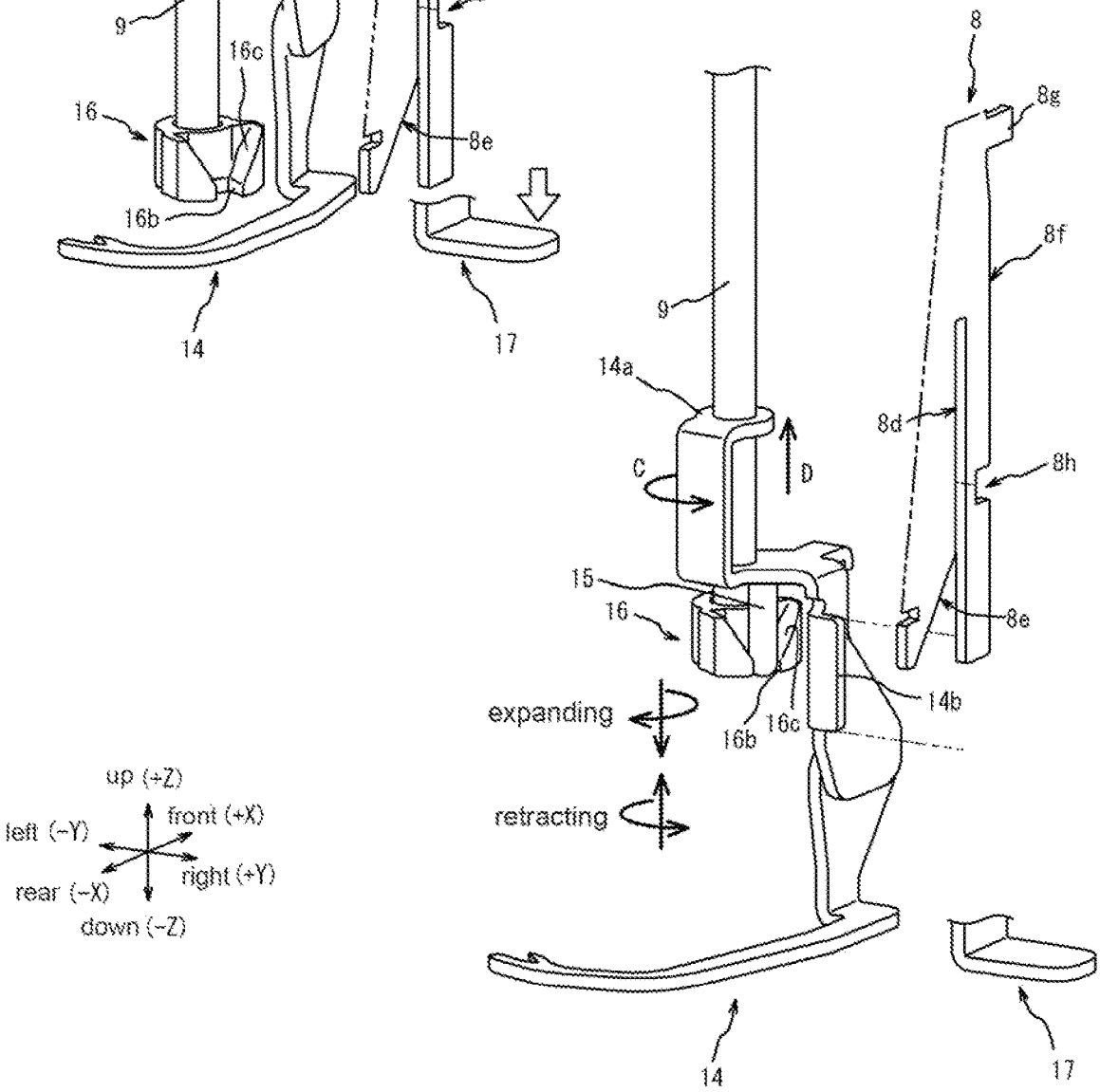

Then, the retracted state and the expanded state of the spreader 14 will be explained with reference to FIGS. 5A and 5B. In FIGS. 5A and 5B, the base plate 8 and the expansion lever 17 are partly shown. In addition, FIG. 5A is a drawing showing the retracted state while FIG. 5B is the drawing showing the expanded state.

As described above, the spreader 14 is integrally moved with the expansion lever 17 and the like in the vertical direction. In the retracted state, the expansion lever 17 and the like are stopped in a state that the positioning portion 13*c* abuts on the lower end portion of the stopper 8*g* by the energizing force in the direction of the arrow D as shown in FIG. 4A. Therefore, the spreader 14 is also stopped in the vertical direction in the retracted state shown in FIG. 5A. In addition, since the spreader retreat cam follower 14*b* is inserted into the spreader slide groove 8*d* in the retracted state, the movement of the spreader 14 in the rotation direction is restricted. As described above, since the energizing force is acted on the spreader 14 in the direction of the arrow mark C, the spreader retreat cam follower 14*b* abuts on the wall surface of the front side of the spreader slide groove 8*d*.

When the expansion lever 17 is pressed downward, the spreader 14 is interlocked with the expansion lever 17 and moved downward in a state that the spreader retreat cam follower 14*b* is inserted into the spreader slide groove 8*d*. The spreader retreat cam portion 8*e* having an inclined shape is provided on the lower part of the spreader slide groove 8*d* so that the width of the groove is gradually increased from the upper part to the lower part in the front-rear direction. Namely, although the operation of the spreader 14 in the rotation direction is restricted in the retracted state shown in FIG. 5A, the restriction of the operation of the spreader 14 in the rotation direction is released in the expanded state shown in FIG. 5B.

Incidentally, since the upper coupler 15 is connected to the spreader 14, the upper coupler 15 is also lowered when the spreader 14 is lowered. Here, the lower coupler 16 connected to the upper decoration shaft 9 is located at the lower part of the upper coupler 15. Therefore, when the spreader 14 is lowered, the upper coupler 15 is inserted into the lower coupler 16 and the lower end part of the upper coupler 15 is fitted to the spreader angle determining cam portion 16*b*. In the present embodiment, since the width of the groove of the spreader angle determining cam portion 16*b* and the outer diameter of the upper coupler 15 are substantially identical, the spreader 14 is integrally rocked with the lower coupler 16 when the upper coupler 15 is fitted to the spreader angle determining cam portion 16*b*.

As shown in FIG. 2, since the follower pin 11 is in contact with the upper decoration cam 7, the upper decoration shaft 9 to which the lower coupler 16 is connected is always rocked in a state that the main shaft 3 is rotated. Therefore, when the spreader 14 is lowered, the spreader angle determining cam portion 16*b* of the lower coupler 16 may not be located immediately below the upper coupler 15 in some cases. On the other hand, the lower coupler 16 of the present embodiment includes the pair of inclined portions 16*c* which is inclined so that the interval is gradually increased from the lower part to the upper part at the upper part of the spreader angle determining cam portion 16*b*. Thus, when the lowered upper coupler 15 is in contact with the inclined portions 16*c*, the spreader 14 is rotated in accordance with the inclined portions 16*c* and the upper coupler 15 is moved toward the spreader angle determining cam portion 16*b*. Namely, the angle deviation between the spreader 14 and the lower coupler 16 is eliminated by the inclined portions 16*c*. Thus, the upper coupler 15 can be smoothly fitted to the spreader angle determining cam portion 16*b* when the spreader 14 is lowered.

As described above, when the expansion lever 17 is pressed downward to switch the spreader 14 from the retracted state to the expanded state, the spreader 14 is lowered while keeping the angle around the upper decoration shaft 9 and then rotated by a predetermined angle at a portion where the upper coupler 15 is fitted to the lower coupler 16. Namely, the spreader 14 is located near the third needle 6 and the like in the expanded state as shown in partially enlarged view of FIG. 1. However, when switching from the retracted state to the expanded state, the spreader 14 is lowered while keeping the angle rotated in the direction of separating from the third needle 6 and the like. Thus, the spreader 14 can be prevented from colliding with the third needle 6 and the like and the needle thread guide 21 and the like provided on the periphery of the third needle 6.

When the retraction lever 18 is pressed for switching from the expanded state to the retracted state as shown in FIG. 4B, the spreader 14 is raised (shown in FIG. 5B) by the energizing force in the direction of the arrow D. Thus, the engagement between the upper coupler 15 and the lower coupler 16 is released. When the engagement between the upper coupler 15 and the lower coupler 16 is released, the spreader 14 is rotated by the energizing force in the direction of the arrow C until the spreader retreat cam follower 14*b* abuts on the wall surface located at the front side of the spreader slide groove 8*d*. Even when the spreader 14 is raised before the rotation is finished, the spreader retreat cam follower 14*b* is in contact with the spreader retreat cam portion 8*e* and the spreader 14 is rotated in the direction of the arrow C. Thus, the spreader 14 can be prevented from colliding with the third needle 6 and the like and the needle thread guide 21 and the like provided on the periphery of the third needle 6. After that, in a state that the spreader retreat cam follower 14*b* is inserted into the spreader slide groove 8*d*, the spreader 14 is raised while keeping the angle and switched to the retracted state.

As described above, when switching from the expanded state to the retracted state, the spreader 14 is rotated in the direction of separating from the third needle 6 and the like and then raised while keeping the angle. Thus, the spreader 14 can be prevented from colliding with the third needle 6 and other members provided on the periphery of the third needle 6.

When the upper decoration mechanism 2 is switched to the retracted state, the upper decoration thread guide 13 and the spreader 14 are separated from the third needle 6 and the like and moved upward. In the retracted state, since the upper coupler 15 is separated from the lower coupler 16, the spreader 14 is not rocked even when the main shaft 3 is rotated. Therefore, the double chain stitch not using the decoration thread T4 can be performed with high workability. When the upper decoration mechanism 2 is switched to the expanded state, the upper decoration thread guide 13 and the spreader 14 are lowered to near the third needle 6 and the like, the upper coupler 15 is fitted to the spreader angle determining cam portion 16*b*, and the spreader 14 is rocked in synchronization with the rotation of the main shaft 3. Thus, the upper decoration sewing shown in FIG. 7 can be performed. Here, the processes of forming the seams of the upper decoration sewing shown in FIG. 7 will be explained with reference to FIG. 6.

Figure 6:
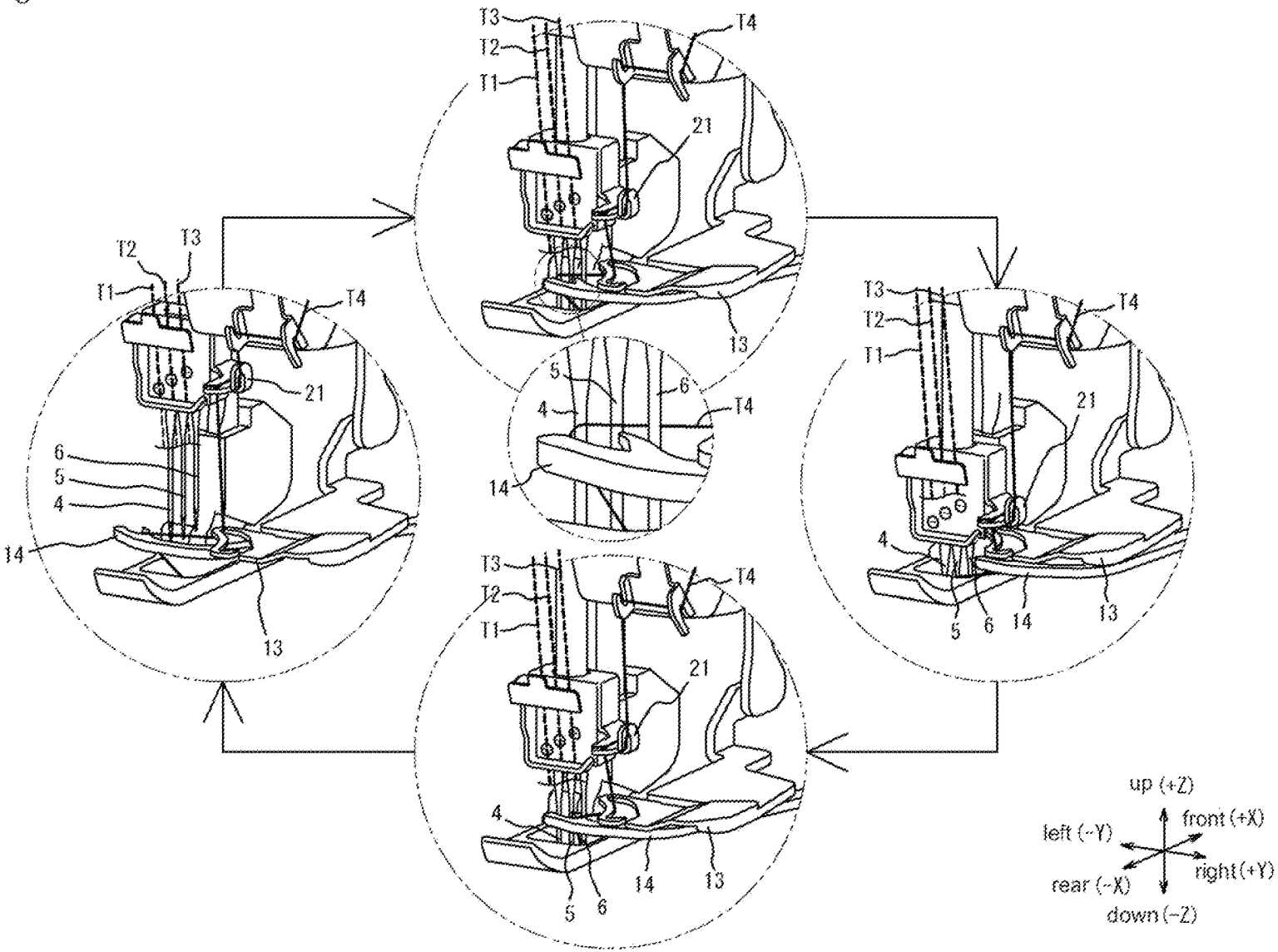
FIG. 6 is an explanatory drawing related to the operation of the upper decoration mechanism shown in FIG. 1.

In FIG. 6, the first needle thread T1, the second needle thread T2 and the third needle thread T3 are inserted into the first needle 4, the second needle 5 and the third needle 6 respectively. The looper thread T5 is inserted into a looper (not illustrated). The decoration thread T4 is inserted into a hole-shaped portion located at the tip portion of the upper decoration thread guide 13. The drawing located at the left side of FIG. 6 shows the state that the first needle 4, the second needle 5 and the third needle 6 are moved to the uppermost position and the spreader 14 is moved to the leftmost position. In the above described state, the tip portion of the spreader 14 captures the decoration thread T4 and holds the captured decoration thread T4 so that the decoration thread T4 crosses the first needle 4 and the like.

Then, as shown in the drawing located at the upper side of FIG. 6, when the first needle 4 and the like are lowered, the third needle 6 passes through the rear side of the decoration thread T4. At this time, the spreader 14 moved to the right releases the decoration thread T4.

Then, as shown in the drawing located at the right side of FIG. 6, the first needle 4 and the like are moved to the lowermost position and cooperate with a not-illustrated looper mechanism, feed mechanism and the like for sewing the decoration thread T4 into the first needle thread T1, the looper thread T5 and the like. Thus, the seams of the upper decoration sewing are formed. At this time, the spreader 14 passes through the decoration thread T4 held by the upper decoration thread guide 13 and moves to the lower right of the hole-shaped portion located at the tip of the upper decoration thread guide 13 (i.e., rightmost position).

After that, as shown in the drawing located at the lower side of FIG. 6, the first needle 4 and the like are raised and the spreader 14 is moved to the left while capturing the decoration thread T4. After the cloth is fed by the feed mechanism, the first needle 4 and the like and the spreader 14 are moved to the position shown in the drawing located at the left side of FIG. 6.

Figure 7:
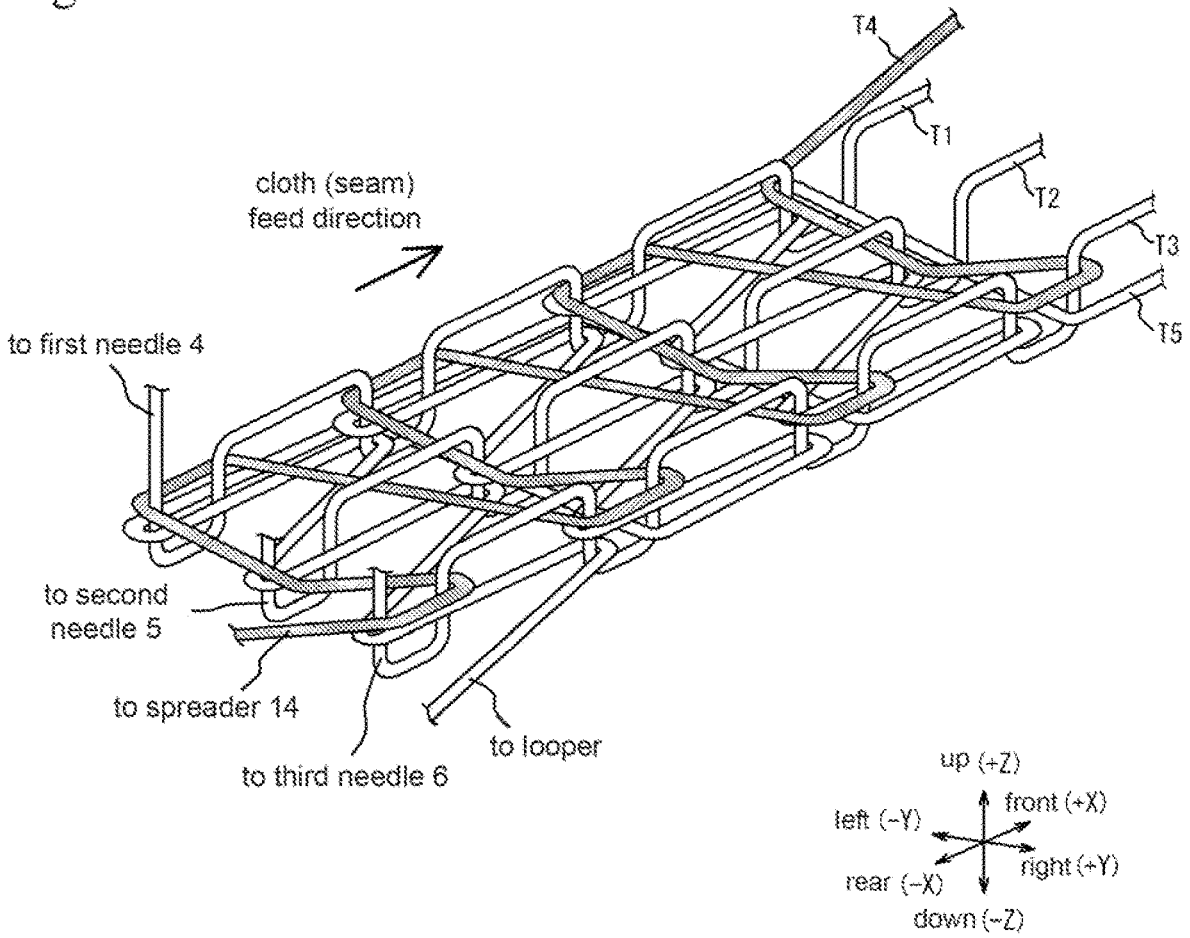
FIG. 7 is an explanatory drawing related to seams of an upper decoration sewing.

After that, the upper decoration sewing shown in FIG. 7 is performed by repeating the above described processes.

The embodiment embodying the present invention is exemplified above. However, the present invention is not limited to the above described specific embodiment. Various variations and modifications are possible within the content of the present invention described in the claims unless particularly limited in the above described explanation. In addition, the above described effects of the embodiment merely exemplify the effects raised from the present invention. The effects of the present invention are not limited to the above described effects.

For example, "expansion retraction mechanism" of the present specification is realized by the configurations mainly formed by the upper decoration shaft 9 and the sliding structure of the support portions 14*a* of the spreader 14 in the upper decoration mechanism 2 of the present embodiment. In addition, the configuration of switching between the expanded state and the retracted state is realized by the interlocking operation of the upper decoration thread guide 13 and the spreader 14 using the sliding structure of the support portions 13*a* of the upper decoration thread guide 13 and the upper decoration shaft 9 and the structure of sandwiching the support portions 13*a* by the support portions 14*a*. However, the present invention is not limited to the above described embodiment. Other configurations can be added or some configurations can be replaced with alternative configurations. For example, instead of the mechanism of switching between the expanded state and the retracted state by the sliding operation in the vertical direction, the spreader 14 and the upper decoration thread guide 13 can be switched between the expanded state and the retracted state by the mechanism of rocking them in the front-rear direction. Alternatively, it is also possible that the spreader 14 is switched between the expanded state and the retracted state by the sliding operation in the vertical direction while the upper decoration thread guide 13 is switched between the expanded state and the retracted state by the rocking motion in the front-rear direction without interlocking with the motion of the spreader 14. In addition, "transmission mechanism" of the present specification is realized by the upper coupler 15 and the spreader angle determining cam portion 16*b* of the lower coupler 16. However, the present invention is not limited to the above described configuration. For example, it is also possible that a member integrally moved with the expansion lever 17 in the vertical direction is provided and the member is interposed between the upper decoration cam 7 and the follower pin 11 to separate the follower pin 11 from the upper decoration cam 7 when the expansion lever 17 is raised. Thus, the transmission of force from the main shaft 3 can be switched. It is also possible that a clutch is provided between the upper decoration shaft 9 and the lower coupler 16, the lower coupler 16 is rocked by the force from the main shaft 3 when the clutch is enabled, and the lower coupler 16 is stopped when the clutch is disabled. It is also possible that two motors: one is a motor for vertically moving the first needle 4; and the other is a motor for rocking the spreader 14 are provided, the two motors are driven in the expanded state, and the motor for rocking the spreader 14 is stopped in the retracted state.

In the present embodiment, the outer diameter of the upper coupler 15 and the width of the groove of the spreader angle determining cam portion 16*b* are substantially identical, and the upper coupler 15, the spreader angle determining cam portion 16*b* and the inclined portions 16*c* also function as "positioning mechanism" of the present specification. For example, it is also possible that the width of the groove of the spreader angle determining cam portion 16*b* is longer than the outer diameter of the upper coupler 15 to function as "transmission mechanism." In such a case, "positioning mechanism" is separately provided. Regarding "positioning mechanism," it is also possible that two motors: one is a motor for vertically moving the first needle 4 and the like; and the other is a motor for rocking the spreader 14 are provided, encoders for measuring the rotation angle of the two motors are provided respectively, the rotation angles of the two motors are measured by the encoders and synchronized with each other to adjust the operation of the first needle 4 and the operation of the spreader 14 to a predetermined timing.

In addition, "guide mechanism" of the present specification is realized by the spreader retreat cam follower 14*b* provided on the spreader 14, the spreader slide groove 8*d* provided on the base plate 8, and the spring energizing the spreader 14 in the direction of the arrow C or the spreader retreat cam portion 8*e* in the present embodiment. However the present invention is not limited to the above described embodiment. For example, it is also possible that the equivalent of the spreader slide groove 8*d* and the spreader retreat cam portion 8*e* is provided for the spreader 14 and the equivalent of the spreader retreat cam follower 14*b* is provided for the base plate 8. In the present embodiment, for ensuring the operation of the spreader 14, both the spring for energizing the spreader 14 in the direction of the arrow C and the spreader retreat cam portion 8*e* are provided. However, when at least one of the spring for energizing the spreader 14 in the direction of the arrow C and the spreader retreat cam portion 8*e* is provided, the spreader 14 can be rotated in the direction of the arrow C after the engagement between the upper coupler 15 and the lower coupler 16 is released.

In addition, the upper decoration mechanism 2 of the present embodiment is housed inside the cover of the sewing machine 1 in the retracted state. However, it is also possible that the upper decoration mechanism 2 is housed outside the cover. For example, the upper decoration mechanism 2 can be configured to be housed outside the front of the arm portion 1*a* since it does not obstruct the operation of the operator and visually obstruct the operator.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. An upper decoration mechanism provided on a double chain stitch sewing machine, the upper decoration mechanism comprising:

an expansion retraction mechanism configured to switch a spreader between an expanded state where the spreader cooperates with a needle for performing an upper decoration sewing and a retracted state where the spreader is separated from the needle; and an upper decoration thread guide configured to guide an upper decoration thread to the spreader, wherein the upper decoration thread guide is configured to move in a vertical direction while being interlocked with the spreader to switch the spreader between the expanded state and the retracted state.

2. The upper decoration mechanism according to claim 1, further comprising:

a transmission mechanism configured to transmit a force for driving the needle from a main shaft to the spreader in the expanded state while the force is interrupted in the retracted state.

3. The upper decoration mechanism according to claim 2, wherein the transmission mechanism includes a positioning mechanism configured to adjust operations of the needle and the spreader to a predetermined timing when switching the spreader from the retracted state to the expanded state.

4. The upper decoration mechanism according to claim 1, further comprising:

a guide mechanism configured to move the spreader in a predetermined path with a predetermined posture when switching the spreader between the expanded state and the retracted state.

5. A sewing machine including the upper decoration mechanism according to claim 1.

* * * * *